United States Patent [19]

Swan, Jr.

[11] 4,247,214

[45] Jan. 27, 1981

[54] CHARACTER POSITION CONTROL FOR A MATRIX PRINTER

[75] Inventor: William O. Swan, Jr., Wichita, Kans.

[73] Assignee: NCR Corporation, Dayton, Ohio

[21] Appl. No.: 958,856

[22] Filed: Nov. 8, 1978

[51] Int. Cl.[3] ..... B41J 29/42

[52] U.S. Cl. ..... 400/705.1; 400/120; 400/124; 400/126; 400/320; 340/870.29; 250/237 G; 346/139 D

[58] Field of Search ..... 400/2, 76, 120, 124, 400/126, 279, 280, 281, 320, 322, 323, 328, 705.1; 346/76 R, 76 L, 76 PH, 75, 139 B, 139 D; 250/231 R, 231 SE, 237 G; 340/201 P

[56] References Cited

U.S. PATENT DOCUMENTS

| | | | |
|---|---|---|---|
| Re. 25,354 | 3/1963 | Rossetto et al. | 400/2 X |
| 2,557,219 | 6/1951 | Flint et al. | 340/201 P X |
| 2,944,157 | 7/1960 | McAuslan et al. | 250/231 SE X |
| 3,153,111 | 10/1964 | Barber et al. | 250/237 G X |
| 3,591,841 | 7/1971 | Heitmann et al. | 250/231 R |
| 3,713,139 | 1/1973 | Sanford et al. | 250/237 G X |
| 3,749,925 | 7/1973 | Hertrich | 250/231 SE X |
| 3,831,728 | 8/1974 | Woods et al. | 400/126 X |
| 3,834,505 | 9/1974 | Fowler et al. | 400/126 |
| 3,891,077 | 6/1975 | Sauerbrunn | 400/124 |
| 3,905,463 | 9/1975 | Boyce et al. | 400/124 |
| 4,050,564 | 9/1977 | Carmichael et al. | 346/139 B X |

FOREIGN PATENT DOCUMENTS

| | | | |
|---|---|---|---|
| 2454237 | 5/1975 | Fed. Rep. of Germany | 400/126 |
| 1267163 | 6/1961 | France | 340/201 P |
| 1340220 | 9/1963 | France | 340/201 P |

*Primary Examiner*—Ernest T. Wright, Jr.
*Attorney, Agent, or Firm*—J. T. Cavender; Albert L. Sessler, Jr.; Elmer Wargo

[57] ABSTRACT

An apparatus for generating pulses for both character and individual "dot" strobing, as for example, in matrix printers. The apparatus includes a first stationary synchronization track and a cooperating first movable synchronization track (to move with the matrix printer) for generating the start of character pulses and a second stationary synchronization track and a second cooperating second movable synchronization track (to move with the matrix printer) for generating individual "dot" pulses of a character to produce vertically aligned characters in a bi-directional printer. The first synchronization tracks are designed to produce pulses having narrow rise and fall slopes for accurate character location and the second synchronization tracks are designed to produce pulses having gradual rise and fall slopes to provide for adjustment of the individual "dot" pulses for bi-directional printing.

16 Claims, 15 Drawing Figures

PRIOR ART

CHARACTER POSITION CONTROL FOR A MATRIX PRINTER

BACKGROUND OF THE INVENTION

This invention relates to an apparatus for generating pulses for character and/or individual "dot" strobing, as for example, in bi-directional matrix printers.

One of the problems of matrix printers which utilize synchronization tracks is that very often the tracks become occluded with dirt and become defective in operation.

Another problem with prior art apparatuses for generating dot strobing pulses is that they do not provide for adjustment of the triggering point at which the pulses are produced, especially in bi-directional printers.

Also, with bi-directional matrix printers of the prior art, it is difficult to maintain vertical alignment of columns of characters printed on a record medium.

SUMMARY OF THE INVENTION

This invention relates to an apparatus for generating pulses for character and/or individual dot strobing, as for example, in a matrix printer.

The apparatus includes a recording means which is movable along a line of printing on a record medium, and is operable in response to first and second signals applied thereto for producing selected imprints along the line so that the resulting characters are formed of a plurality of the imprints. The apparatus also includes first means for producing the first signals which indicate character start positions or recording frames along the line of printing and second means for producing the second signals, which in turn, produce the selected imprints within the recording frames. The first and second means each comprise: a first synchronization track having spaced synchronization marks thereon, with the first tracks being fixed relative to the recording means; a second synchronization track having spaced synchronization marks thereon, with the second tracks being movable with the recording means; and a light source and detector means being positioned in light coupling relationship with the first and second synchronization tracks to produce the associated first and second signals as the recording means moves along the line of printing.

The synchronization tracks of the first means are designed to produce the first signals having narrow rise and fall times for accurate character or recording-frame location, and the synchronization tracks of the second means are designed to produce the second signals having gradual rise and fall slopes to provide for adjustment of the individual "dot" pulses when the apparatus is used in a matrix printer. This enables the characters to be accurately aligned, vertically when the apparatus is used in a bi-directional matrix printer.

These advantages and others will be more readily understood in connection with the following specification, claims, and drawing.

DETAILED DESCRIPTION OF THE INVENTION

Figure 1:
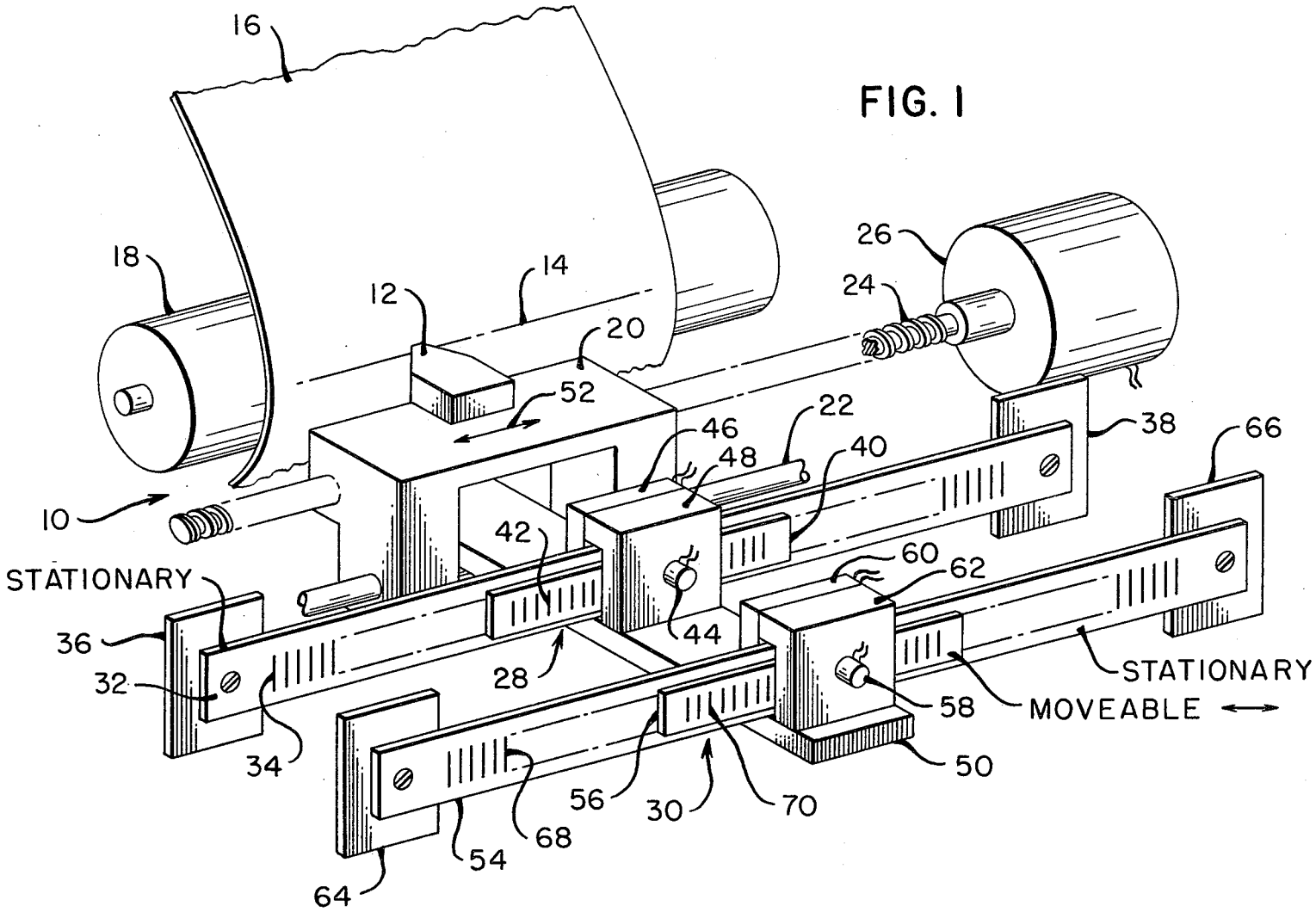
FIG. 1 is a general, perspective view of the apparatus of this invention showing a movable recording means, first means for producing first signals which indicate character start positions and second means for producing second signals which are used for producing selected imprints along a line of printing on a record medium which is in operative relationship with the recording means.

FIG. 1 is a general perspective view of the apparatus of this invention which is designated generally as 10. The apparatus 10 includes a recording means 12 which may be a conventional matrix printer such as, for example, a thermal or a wire matrix printer. The recording means 12 is movable along a line of printing 14 on a record medium 16 which is positioned on a platen 18 to be conventionally advanced and retained thereon by conventional means (not shown). The recording means 12 is mounted on a carriage 20 which is slidably mounted on a stationary rod 22 and traversed along the line of printing 14 by any conventional means such as a traversing screw 24 and a bi-directional motor 26 which are conventionally and operatively connected to the carriage 20.

The apparatus 10 (FIG. 1) also includes a first means 28 for producing first signals which are utilized to indicate character start or recording frame positions along said line of printing 14 and a second means 30 for producing second signals which are utilized for producing selected imprints which comprise a character being printed by the recording means 12 within a recording frame.

The first means 28 (FIG. 1) includes a first synchronizing track 32 having spaced synchronization marks 34 thereon, with the nature of these marks 34 being described later herein. The first track 32 is fixed relative to the recording means 12 and record medium 16 by securing the opposed ends thereof to frame members 36 and 38. The first means 28 also includes a second synchronizing track 40 having spaced synchronization marks 42 thereon, with the nature of these marks 42 being described later herein. The first means 28 also includes a light source 44 and a detector means such as a photodetector 46 which are positioned in light coupling relationship with the first and second synchronization tracks 32, 40 which are shown in exaggerated size to facilitate the showing thereof. The light source 44 is mounted in a bracket 48 which is fixed to the extension 50 which is part of the carriage 20. The photodetector 46 is also fixed to the bracket 48 to receive the light from the light source 44 as it passes through the synchronization marks 42 of the second track 40 and the synchronization marks 34 of the first track 32. The second track 40 is fixed to the bracket 48 and the first track 32 is aligned therewith to enable the first and second tracks (32, 40) to be in sliding engagement with each other as the carriage 20 is moved in opposite directions as shown by the arrow 52 to enable the recording means 12 to effect bi-directional printing along the print line 14.

The second means 30 (FIG. 1) similarly includes a first synchronization track 54, a second synchronization track 56, and a second detector means which includes a light source 58 and a photodetector 60. The light source 58 is fixed in a bracket 62 which is fixed to the extension 50, and the photodetector 60 is also fixed to the bracket 62 to sandwich the first and second tracks 54, 56 therebetween as shown. The second track 56 is fixed to the bracket 62 to move with the carriage 20 and the first track 54 is aligned with the second track 56 and then is fixed to the brackets 64 and 66 to enable the first and second tracks 54, 56 to move relative to each other as the recording means 12 is moved along the print line 14. The first track 54 has a plurality of synchronizing marks 68 thereon, and similarly, the second track 56 has a plurality of synchronizing marks 70 thereon, with the nature of these marks (68, 70) to be described later herein.

FIGS. 2A, B and C show various forms which the first and second synchronization tracks 32, 40 of the first means 28 may take. The first and second tracks 32, 40 may be made of opaque material with slits therein to provide the synchronization marks 34, 42 or they may be made of light impervious material having light pervious or clear areas therein to provide the synchronization marks 34, 42.

Before proceeding with a discussion of the various synchronization tracks disclosed herein, it would appear beneficial to first discuss "dot strobing" for wire matrix printers, for example, in a general way.

For dot strobing, let:

C = the horizontal spacing along the print line 14 (FIG. 1) from the start of one character to the start of the next character;

D = the horizontal spacing from the center of one dot (produced by the recording means 12 along the print line 14) to the center of the next adjacent dot;

I = the horizontal spacing from the last dot of one character to the first dot of the next character (inter-character spacing); and P = the number of dot positions per character.

Therefore, $C = PD + I$

For the apparatus or system under consideration, $I = KD$, wherein K is an integer (1, 2, 3, etc.).

A typical recording means 12, when employing a wire matrix print head, may have the following parameters:

$C = 10^{-1}$ inch,
$D = 10^{-2}$ inch,
$I = 3 \times 10^{-2}$ inch,
$P = 7$, and
$K = 3$.

Figure 4:
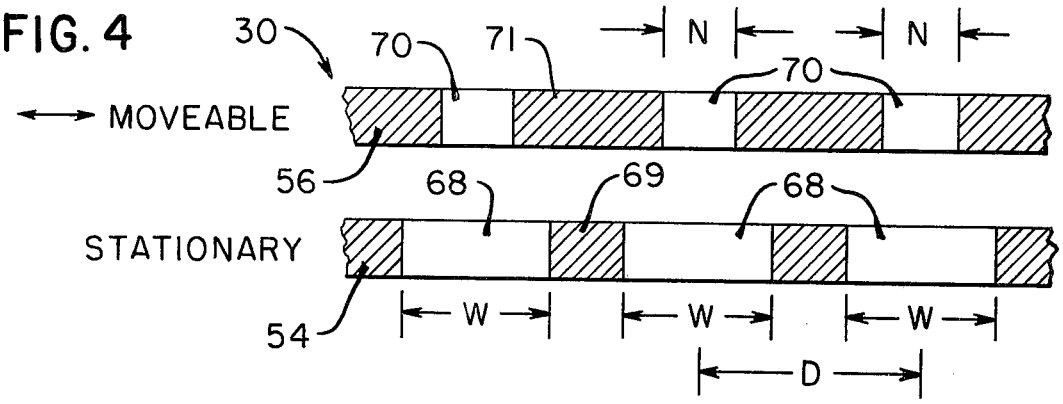
FIG. 4 shows a preferred embodiment of the second means shown in FIG. 1.

Next, consider the first synchronization track 54 of the second means 30 (FIG. 1) as having synchronization marks 68 which are clear areas having a width (as measured along the line of printing 14) equal to W as shown in more detail in FIG. 4. The synchronization marks 70 of the second synchronization track 56 (FIG. 4) have a width of N which, for convenience, is defined as being less than W. Optical transmission of light through the synchronizing marks 70 and 68, when they are aligned, is defined to be a fraction of the transmission of light which would occur if both clear areas (marks 70 and 68) were of infinite width.

Figure 10:
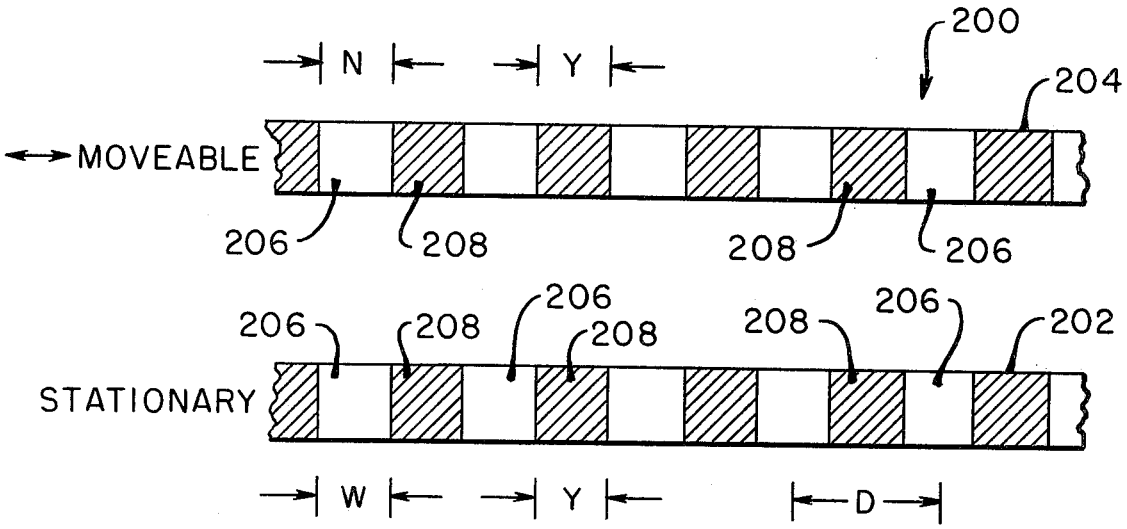
FIG. 10 shows a prior-art construction of a moveable track and stationary track for producing synchronization signals.

In this regard, FIG. 10 shows a prior-art construction designated generally as 200 for producing synchronization signals. The construction 200 includes a stationary track 202 and a moveable track 204 which together operate in the same general manner as does the second means 30, for example. The tracks 202 and 204 are identical, with the track 202, for example, having alternating clear areas 206 and opaque areas 208 as shown. The clear areas 206 in track 204 have a width equal to N, and the clear areas 206 in track 202 have a width equal to W. The opaque areas 208 in tracks 202 and 204 have a width equal to Y and D is equal to the horizontal spacing from the center of one dot (for printing) to the center of the next adjacent dot as previously defined.

With regard to FIG. 10, when N equals W, and Y equals W, then, $W = N = Y = D/2$; and the maximum transmission of light ($T_M$) in such a situation is equal to $N/D = \frac{1}{2}$.

Figure 11:
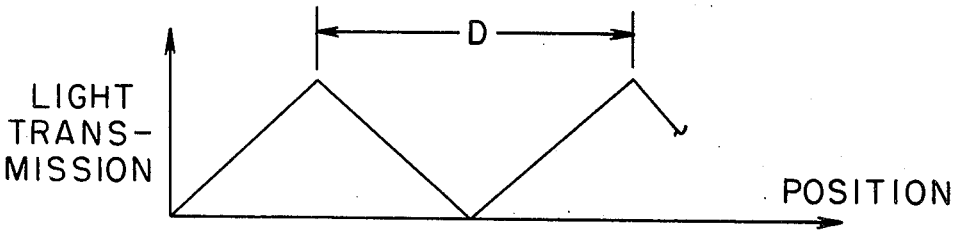
PRIOR ART FIG. 11
FIG. 11 shows a light transmission pattern associated with the prior-art construction shown in FIG. 10.

FIG. 11 shows a light transmission pattern associated with the construction 200 shown in FIG. 10 as the track 204 is moved relative to track 202.

Figure 5:
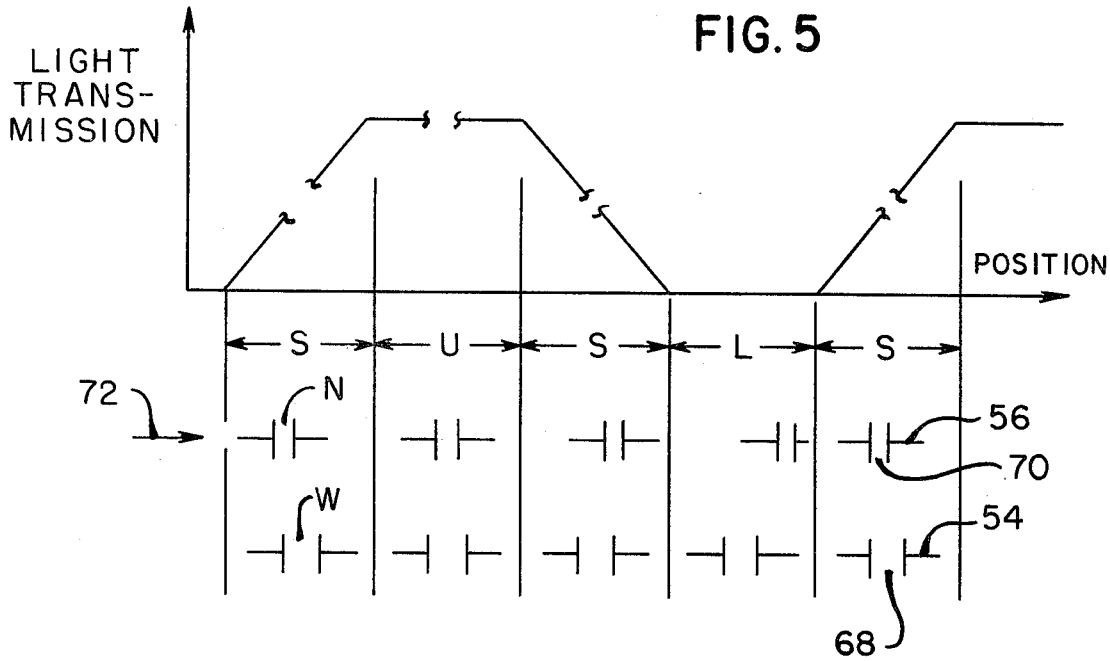
FIG. 5 shows the light transmission pattern associated with first and second tracks which are associated with the second means for producing the second signals as the tracks are moved relative to each other.

Next, consider the generalized light transmission pattern shown in FIG. 5, showing light transmission as a function of the position of the recording means 12 as it moves along the line of printing 14 in the direction indicated by arrow 72 for the second means 30 shown in FIGS. 1 and 4. W in FIG. 5 represents the width of the synchronization marks 68 as previously defined, and N represents the narrower synchronization marks 70 for the track 56.

From a consideration of the geometry involved in FIG. 5 and using the symbols W, N, and D previously defined, let $S = N$, wherein S equals the slope or distance over which the transmission of light is increasing and decreasing as the synchronization track 56 is moved relative to the synchronization track 54, let $U=W-N$, wherein U equals the distance over which the transmission of light is constant as the synchronization track 56 is moved relative to the synchronization track 54, let $L=D-(N+W)$, wherein L equals the distance over which there is no transmission of light as the synchronization track 56 is moved relative to the synchronization track 54, and let $T_M=N/D$.

From these equations, it is apparent that the slope S (increasing and decreasing light transmission) and the maximum light transmission $T_M$ are proportional to the width of the narrow synchronizing mark N. A useful compromise for such a system may be found as follows:

Let $S=U=L$;

Now $U=L$, therefore $W-N=D-(N+W)$ or $W=D/2$ or about $10^{-2}/2=5\times10^{-3}$ inch.

Also $S=U$, therefore $N=W-N=W/2=D/4$ or about $2.5\times10^{-3}$ inch for the second means 30 shown in FIGS. 1 and 4, and $T_M=N/D=\frac{1}{4}$.

With regard to the second means 30 best shown in FIG. 4, the first synchronization track 54 thereof has a repeating pattern comprised of clear and opaque areas with opaque area 69 having a first width and with the following clear area 68 (W) having a width which is twice the width of the opaque area 69. The second synchronization track 56 has an opaque area 71 which is equal in width to the clear area 68 and the following clear area 70 (N) has a width which is equal to half the width of the clear area 68 (W).

The apparatus 10 (FIG. 1) has bi-directional printing capability with the resulting printed characters being in vertical alignment whether printing is effected from left to right or from right to left. In order to accomplish this, allowance must be made for the finite time lapse between the generation of a dot print strobe signal and the actual impact against the record medium 16 by an individual print wire in the recording means 12 due to the fact that the recording means 12 is moving along the print line 14 at this time. The apparatus 10 incorporates a feature to provide a "phasing adjustment" between the generation of a strobe signal and the actual imprint or impact on the record medium 16; however, this aspect will be discussed later herein with regard to a control means used with the apparatus 10. Naturally, the stability of the apparatus 10 depends upon a relatively constant velocity of the recording means 12 while moving along the pring line 14.

Figure 6:
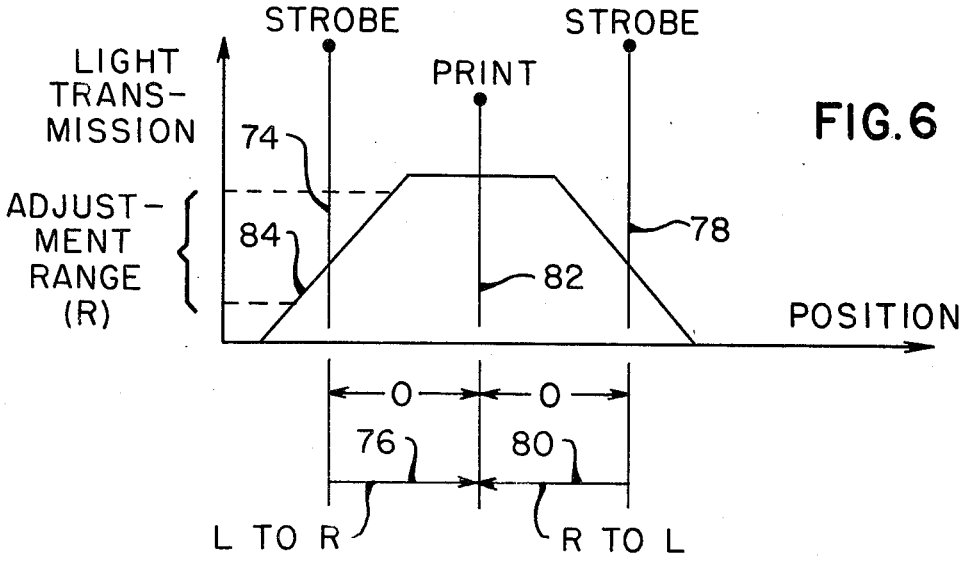
FIG. 6 is a diagram showing the relationship between the generation of a second signal (strobe pulse) and the actual imprint by the recording means when printing from left to right and right to left.

To effect bi-directional printing with accurate vertical registration of the resulting characters, two strobe positions are provided for each print position with regard to the second means 30 shown in FIG. 1. FIG. 6 shows a strobe position represented by line 74 for left to right printing shown by arrow 76, and similarly, line 78 represents a strobe position for right to left printing represented by arrow 80 to effect printing at a location represented by line 82. For example, the line 74 represents the point at which the increasing light transmission (as represented by line 84) is sufficient to actuate the associated photodetector, like 60. The "phasing adjustment" mentioned earlier herein provides an adjustment range (R) along the line 84 which enables the strobe pulse to be adjusted upwardly or downwardly for either direction of printing to provide less or more elapsed time, respectively, between the generation of the strobe pulse and the actual imprint on the record medium 14. FIG. 6 shows the offset distance (represented by 0) between the generation of a strobe pulse and the actual imprint.

The nominal offset distance 0 (FIG. 6) is represented by:

$$0=\frac{U+S}{2}=\frac{W-N+N}{2}=\frac{W}{2},$$

or $W=2\times0$, using the symbols previously defined. This indicates that the wider opening W (synchronization mark 68 in synchronization track 54 in the embodiment described) has a dimension which is twice the required offset. For example, assume that the total adjustment range R of the offset adjustment is equal to half the range of the slope S (FIG. 5), then $R=S/2=N/2$, or $N=2R$, using the symbols previously defined.

Thus, it can be seen that the required offset distance determines W, and the required adjustment range R determines N (the narrow opening or synchronization mark 70 in synchronization track 56, for example). Naturally, the particular print characteristics such as the spacing between adjacent dots also affect the determination of the openings W and N for the second means 30 (FIG. 1) for producing the strobe pulses or second signals as previously described.

These same techniques can be employed to determine the wide (W) and narrow (N) openings in the first and second synchronization tracks 32 and 40, respectively, of the first means 28 shown in FIG. 1; it should be recalled that the first means 28 is used for producing the first signals or strobe pulses to indicate character start positions along the line of printing 14. For example, the narrow opening N (synchronization mark 42 in second track 40) is equal to the character slope. Using the symbols previously defined herein except adding the subscript c to differentiate terms specific to the first means 28, $$N_c=S_c.$$

The wide mask opening W (synchronization mark 34 in first track 32) is equal to the intercharacter space minus the slope, i.e.

$$W_c=I-S_c=I-N_c$$

Some typical values of the openings $W_c$ and $N_c$ are:

$$S_c=N_c=D/2=5\times10^{-3}\text{ inch;}$$

$$W_c=I-S_c=3\times10^{-2}-5\times10^{-3}=2.5\times10^{-2}\text{ inch;}$$

and $$T_{Mc}=\frac{N_c}{C}=\frac{5\times10^{-3}}{10^{-1}}=.05$$

The light transmission coefficient $T_{Mc}$ above, obviously is quite low; however, the embodiments shows in FIGS. 2A, B and C for the first means 28 provide improved characteristics for producing the first signals.

Figure 2:
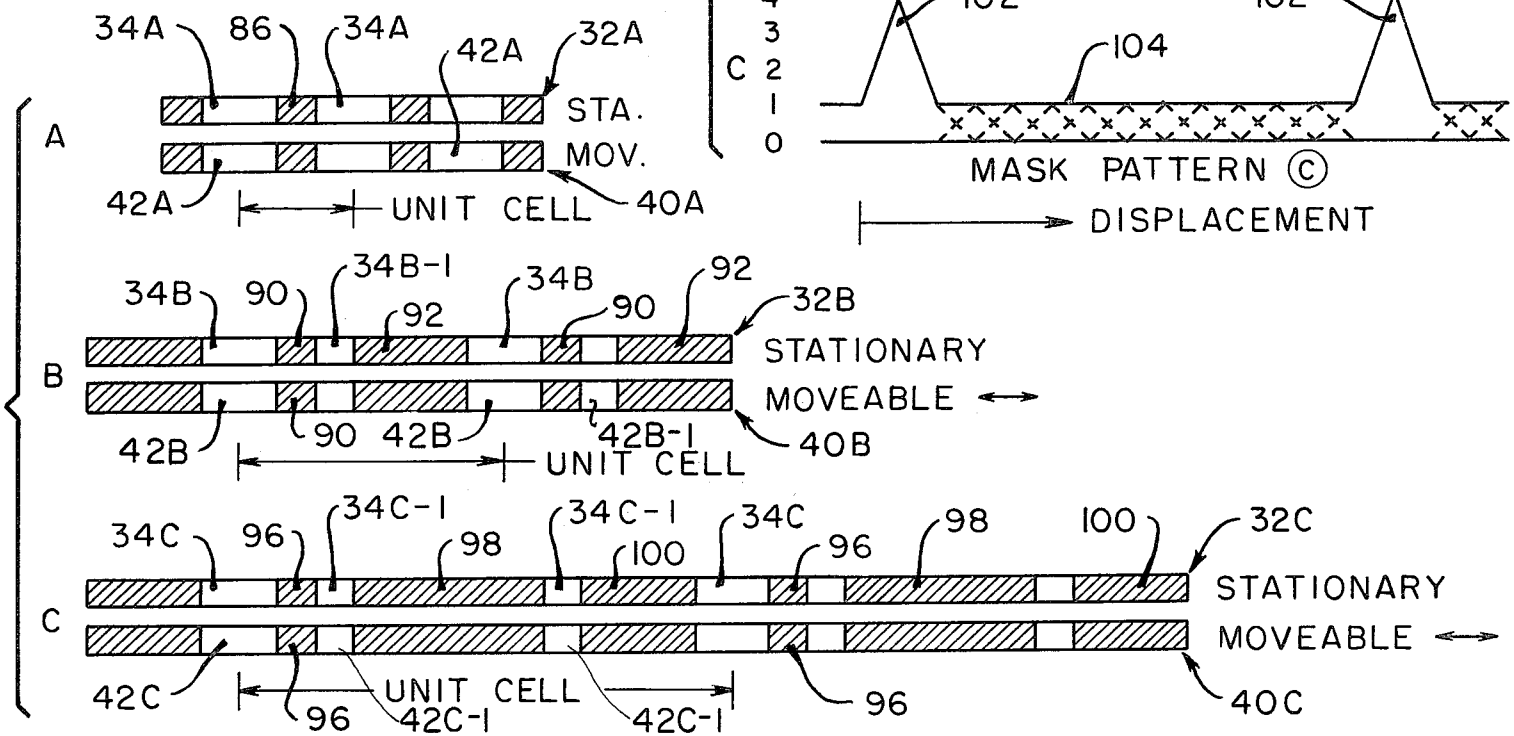
FIGS. 2A, B and C show various designs of first and second synchronization tracks which are associated with the first means for producing the first signals.

FIGS. 2A, B and C show various embodiments of portions of the first (32A, 32B, and 32C) and second tracks (40A, 40B, and 40C) of the first means 28 for producing the first signals or strobe pulses for generating the character start positions or recording frames mentioned earlier herein. The first tracks in FIGS. 2A, 2B, and 2C are generally referenced as 32A, 32B, and 32C, respectively, and similarly, the second or movable tracks are generally referenced as 40A, 40B, and 40C, respectively. A feature of the first (32, 32A, 32B, and 32C) and second tracks (40, 40A, 40B, and 40C) of the first means 28 is that the tracks like 32B and 40B, for example, have a number of synchronization marks 34B and 42B, respectively, (clear areas) therein which are specially spaced so that all of the synchronization marks 34B and 42B are open or are aligned to transmit light therethrough to produce the first signal or character strobe, but for the rest of time, the synchronization marks 34B and 42B become aligned one at a time. For example, the first and second tracks 32A and 40A, respectively shown in FIG. 2 are identical in construction, with the first track 32A having synchronization marks or clear areas 34A having a width which is twice the width of the opaque area 86 between consecutive clear areas 34A, and with a unit cell extending from the midpoint of one clear area 34A to the midpoint of the next adjacent clear area 34A as shown. As the second or movable track 40A (having synchronization marks 42A) is moved at a constant rate relative to the stationary track 32A, the light output pattern shown in FIG. 3A will be produced. When the tracks 32A and 40A are aligned as shown in FIG. 2A, the maximum light output is generated as shown by the peaks 88 in FIG. 3A.

Figure 3:
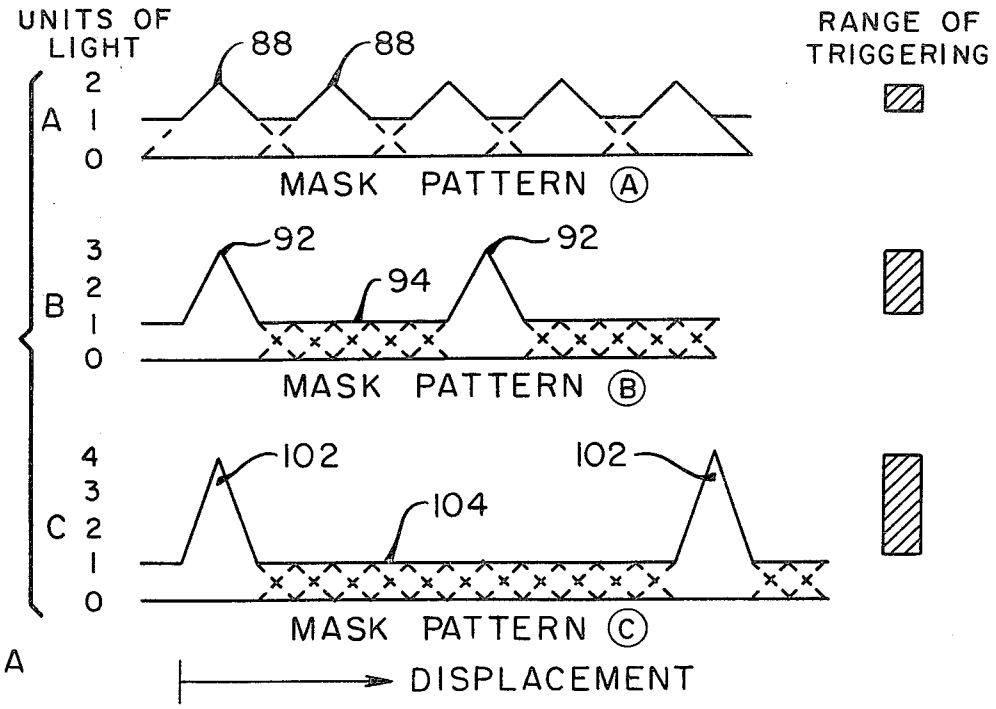
FIGS. 3A, B and C show various output light patterns associated with the synchronization tracks shown in FIGS. 2A, B and C, respectively.

The first and second tracks 32B and 40B shown in FIG. 2B are identical in construction and similarly have synchronization marks 34B or clear areas 34B which have a width which is twice the width of the opaque areas 90, and with the widths of the clear areas 34B-1 being equal to the width of opaque areas 90. The width of opaque area 92 is equal to three times the width of opaque area 90. As shown in FIG. 2B, the width of a unit cell includes one half the width of clear area 34B, the width of an opaque area 90, the width of a clear area 34B-1, the width of opaque area 92 and half the width of the next succeeding clear area 34B. The light output received at the photodetector 46 when the second track 40B is moved relative to the first track 32B is shown in FIG. 3B. Notice that the rate of rise of light intensity (as shown by the Units of Light per unit of displacement) produces peaks 92 which are much steeper and spaced further apart in FIG. 3B than the peaks 88 of FIG. 3A. There is a certain amount of light (shown by line 94) which continually passes through the synchronization marks (34B, 34B-1, 42B, 42B-1) as the track 40B moves relative to the track 32B; however, the peaks 92 occur when these tracks (32B, 40B) are aligned in the position shown in FIG. 2B.

The first and second tracks 32C and 40C shown in FIG. 2C are identical in construction and similarly have synchronization marks or clear areas such as 34C, 42C which have a width which is twice the width of the opaque areas 96, and with the widths of the clear areas 34C-1, 42C-1 being equal to the width of the opaque area 96. The width of the opaque area 98 is equal to five times the width of the opaque area 96, and the width of opaque area 100 is equal to three times the width of opaque area 96. As shown in FIG. 2C, the width of a unit cell includes one half the width of clear area 34C, the width of opaque area 96, the width of clear area 34C-1, the width of opaque area 98, the width of clear area 34C-1, the width of opaque area 100 and one-half of the width of the succeeding clear area 34C. The light output which is received at the photodetector 46 when the second track 40C is moved relative to first track 32C is shown in FIG. 3C. Notice that the rate of rise of light intensity as shown by the Units of Light per unit of displacement produces peaks 102 which are much steeper in FIG. 3C than the peaks 92 of FIG. 3B. There is a certain amount of light shown by line 104 which continually passes through the synchronization marks (34C, 34C-1, 42C, 42C-1) as the track 40C moves relative to the track 32C; however, the peaks 102 occur when these tracks (40C, 32C) are aligned in the position shown in FIG. 2C. Notice that the range of triggering (FIGS. 3A–3C) progressively increases when proceeding from the embodiments of the first (32A, 32B, 32C) and second tracks (40A, 40B, 40C) shown in FIGS. 2A–2C, respectively; this enables the first signals to be accurately produced along the range of triggering which is directly related to units of light which are received at the photodetector 46 for the various embodiments shown. The embodiments of the first (32A, 32B, 32C) and second tracks (40A, 40B, 40C) of the first means 28 shown in FIGS. 2A–2C produce a single strobe or first signal for each character position.

Figure 7:
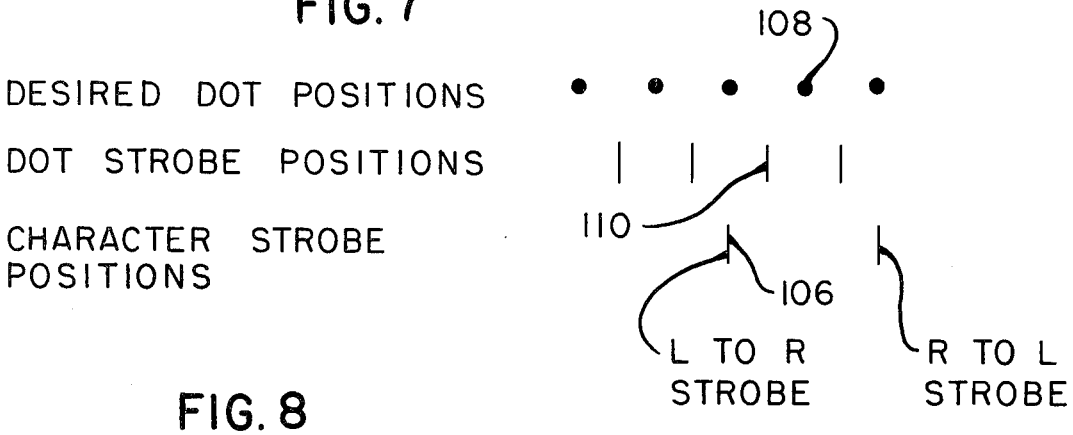
FIG. 7 is a schematic diagram showing the relationship between a character strobe or first signal relative to a desired dot position at the line of printing.

FIG. 7 shows the general relationship between the desired dot positions and the character strobe or first signal positions. In general, the first (32A, 32B, 32C) and second tracks (40A, 40B, 40C) of the first means 28 (FIGS. 2A–2C) should be dimensioned according to the techniques earlier described herein so that the resulting adjacent peaks such as 102 in FIG. 3C occur at a distance which is equal to about twice the width or spacing between adjacent dot positions. The desired dot strobe or second signals occur at the dot strobe positions shown in FIG. 7. For example, when printing from left to right along the line of printing 14 in FIG. 1, the L to R strobe for the start of a character occurs at the character strobe position shown by line 106 to produce the desired dot position represented by dot 108. The associated dot strobe or second signal would be produced at the dot strobe position referenced by line 110 in FIG. 7. This enables the characters to be vertically aligned on the record medium 16 when printing along the line of printing 14. Naturally, the associated tracks 32, 40, 54, 56 of the first and second means 28, 30 are aligned relative to each other to obtain the desired strobe positions shown in FIG. 7.

Figure 8:
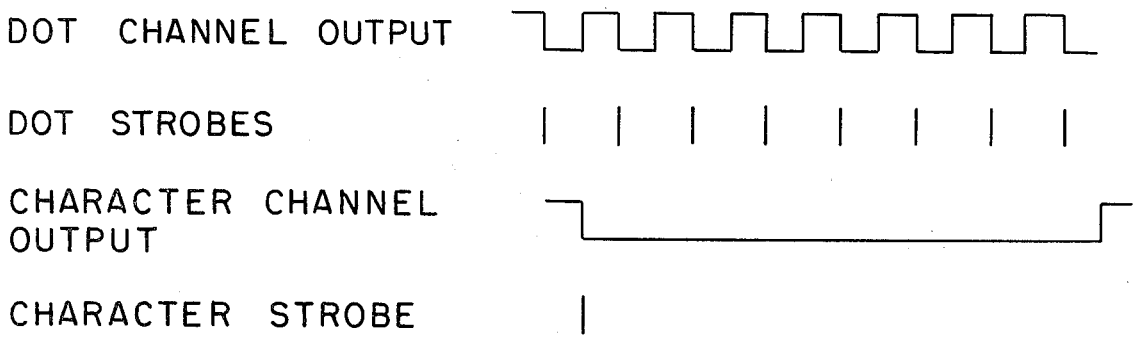
FIG. 8 shows a series of logic signals which are developed by a conventional printer control means shown in FIG. 9.

FIG. 8 shows a series of logic signals which are developed by a conventional recording control means 112 (FIG. 9) which is used to receive the first and second signals from the photodetectors 46, 60 of the first and second means 28, 30 and to also receive the print data input for data to be printed from a conventional printer data handling and control means 114 and to energize the associated print wires, for example, in the recording means 12. When a character strobe or first signal is received by the recording control means 112, the character channel output (FIG. 8) falls for example, to a low level and remains at this low level for seven dot strobes or second signals when there are seven dot strobes making up an individual character. The individual dot strobes (FIG. 8) or second signals are used by the recording control means 112 to produce the dot channel output which is used for strobing the individual print wires of the wire matrix printer utilized in the recording means 12.

Earlier herein, it was stated with regard to FIG. 6, that there is a certain "phasing adjustment" which is provided by the apparatus 10 between the generation of a strobe signal and the actual imprint or impact on the recording medium 16. The phasing adjustment for the adjustment range R (shown in FIG. 6) is effected by the threshold adjustment means 116 and 118 shown in FIG. 9 which may, for example, be variable resistors which can be used conventionally to set the threshold limit for the varying output coming from the photodetector 46 for generating the first signals and to set the threshold limit for the varying output coming from the photodetector 48 for generating the second signals. The phasing adjustment permits greater flexibility than prior art systems employing "one-shot timing", and permits such adjustment for bi-directional printing.

Figure 12:
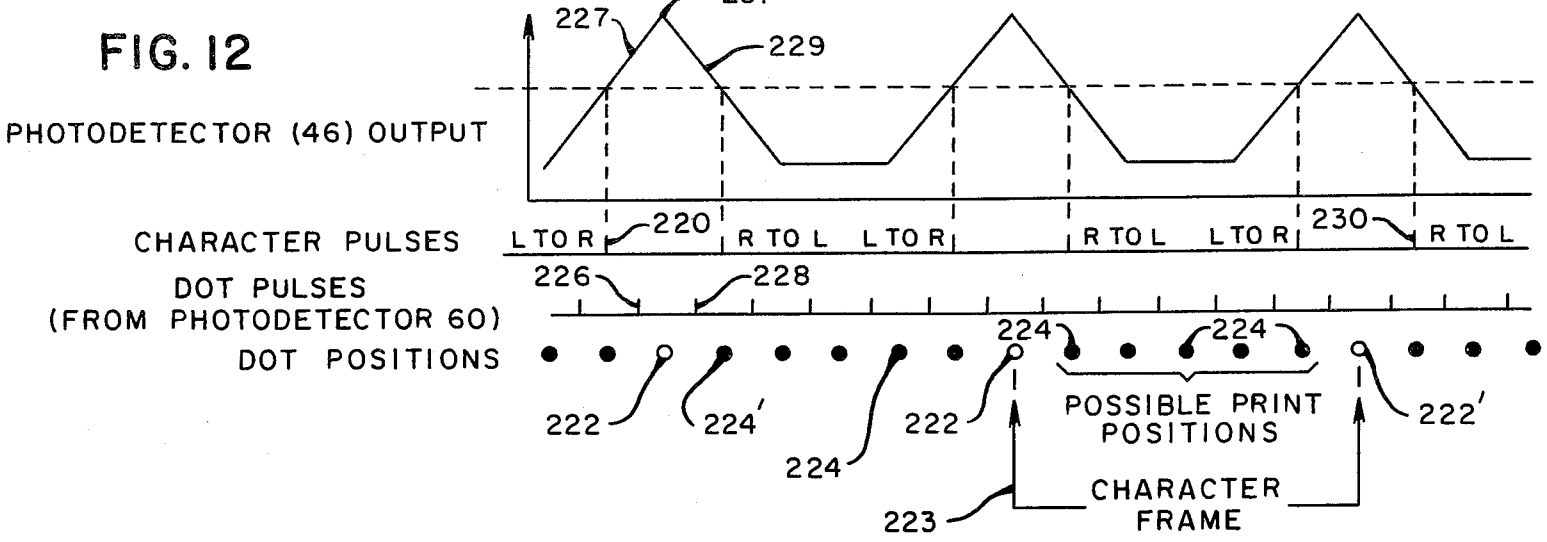
FIG. 12 is a schematic diagram showing the relationship between the character pulses or first signals and the dot pulses or second signals for an embodiment in which the character pulses are generated by a rising light level at the associated photodetector.

FIG. 12 is a schematic diagram showing the relationship between the character pulses or first signals from the photodetector 46 and the dot pulses or second signals from photodetector 60 for an embodiment in which the character pulses are generated by a rising light level at the associated photodetector 46 for the embodiments shown in FIG. 2. When printing from left to right (L to R) for example, the character pulse shown at 220 is used to locate the start of a character frame which is shown as a clear circle 222. Succeeding clear circles 222 form a character frame 223 as shown, and the solid circles such as 224 indicate possible print positions along the line of printing 14 (FIG. 1). In FIG. 12 there are five possible print positions 224 shown within the character frame 223. The character pulse 220 is utilized by the recording control means 112 (FIG. 9) to suppress the next dot pulse or second signal 226 (FIG. 12) and to permit printing to start at print position 224' which is associated with the second signal 228 when printing from left to right. The output from photodetector 46 has a rising slope 227 and a falling slope 229 with a change of direction or a peak 231 therebetween, with the dot pulse 226 occurring after the generation of the character pulse 220 but before the peak 231 as shown in FIG. 12 when printing from left to right, for example. When printing from right to left (R to L), the character pulse or first signal such as 230 is similarly used to locate the start of the character frame 223 represented by clear circle 222'.

Figure 13:
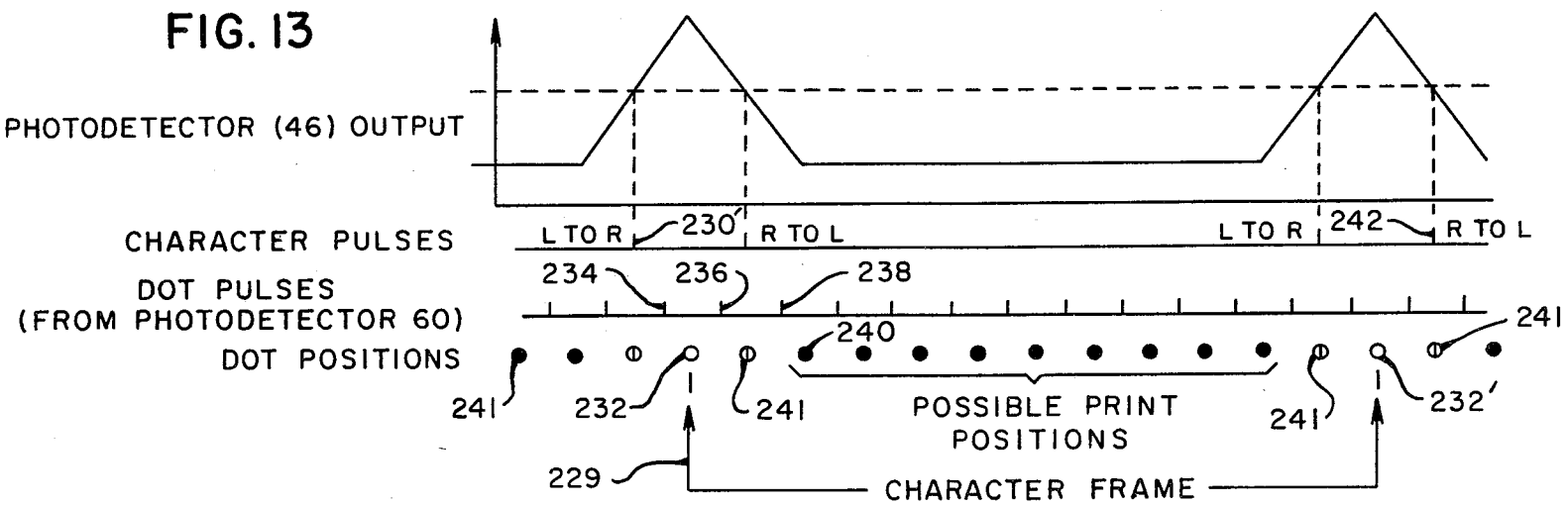
FIG. 13 is a diagram similar to FIG. 12 showing an embodiment which has a greater number of possible print positions within a recording frame than the embodiment shown in FIG. 12.

FIG. 13 is substantially similar to FIG. 12 except a greater intercharacter space is provided and nine possible print positions are provided within a character frame 229. The character pulse such as 230', which is generated by a rising light level at the associated photoconductor 46, is utilized to indicate the start of the character frame 229 represented by clear circle 232 when printing from left to right along the line of printing 14. The dot pulses 234 and 236 are similarly suppressed as described in relation to FIG. 12, and the dot pulse 238 is utilized for printing at the first print position shown as a solid circle 240; circles such as 241 may represent inter-character spacings. It is apparent that as different ones of the dot pulses such as 234 and 236 are suppressed or not suppressed, different or no intercharacter spacings can be effected. When printing from right to left, the character pulse 242 is similarly used to indicate the start of the character frame 229 represented by clear circle 232'.

Figure 14:
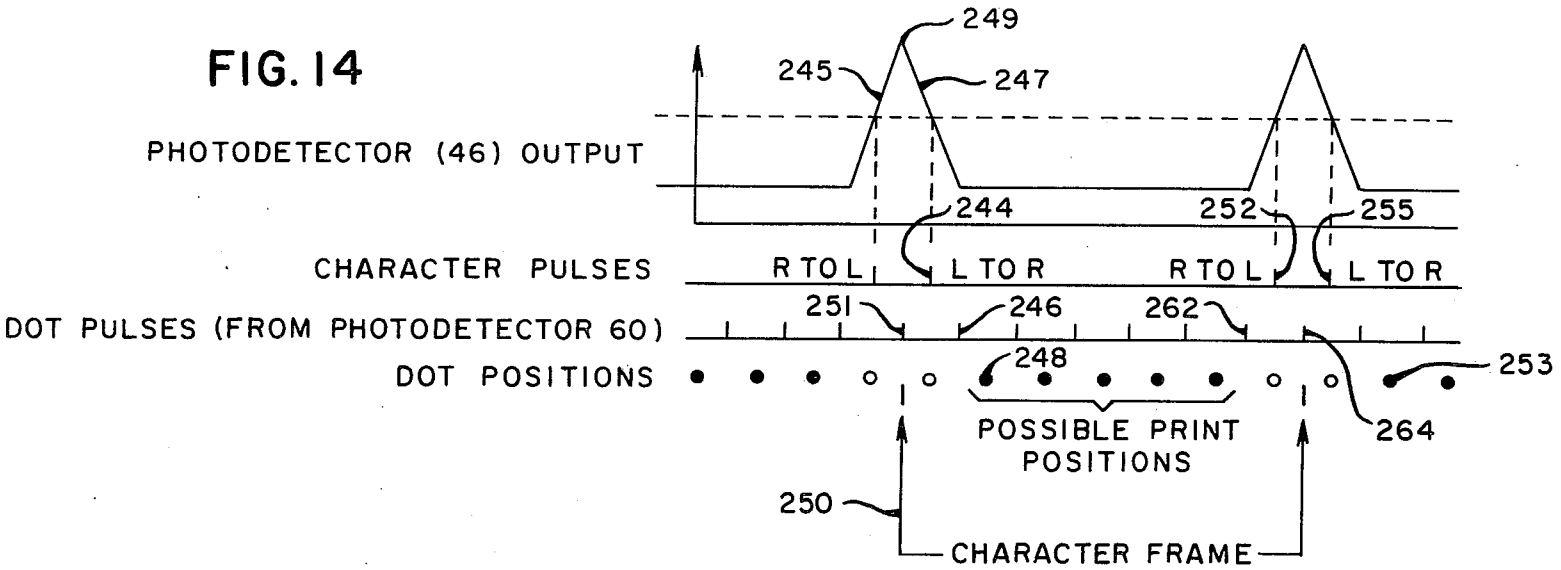
FIG. 14 is a schematic diagram showing the relationship between character pulses or first signals and dot pulses or second signals for an embodiment in which the character pulses are generated by a falling light level at the associated photodetector.

FIG. 14 is a schematic diagram showing the relationship between the character pulses or first signals from the photodetector 46 and the dot pulses or second signals from the photodetector 60 for the embodiments shown in FIG. 2 in which a character pulse is generated by a falling light level at the trailing edge of the output of the associated photodetector 46. When printing from left to right along the line of printing 14, the character pulse shown at 244 occurs at a falling light level as described, and the next dot pulse shown at 246 is used for printing at the first print position 248 within the character frame 250 in which five possible print positions are shown. Conventional logic circuitry (not shown) within the recording control means 112 is utilized to generate the character pulse from the falling light level from the photodetector 46. As previously described in relation to FIG. 12, the output of the photodetector 46 has a rising slope 245, a falling slope 247 and a change of direction or an apex 249 therebetween, with the character pulse 244, in this case, being generated at the trailing edge or falling slope 247 thereof when the recording means 12 is moved from left to right, for example. The dot pulse 251 similarly occurs between the apex 249 and the character pulse 244. The dot pulses 262 and 264 could similarly be suppressed as previously described and the next character pulse 255 could then be used to start printing at print position 253 when printing from left to right. When printing from right to left, the character pulse shown at 252 is similarly used.

Figure 15:
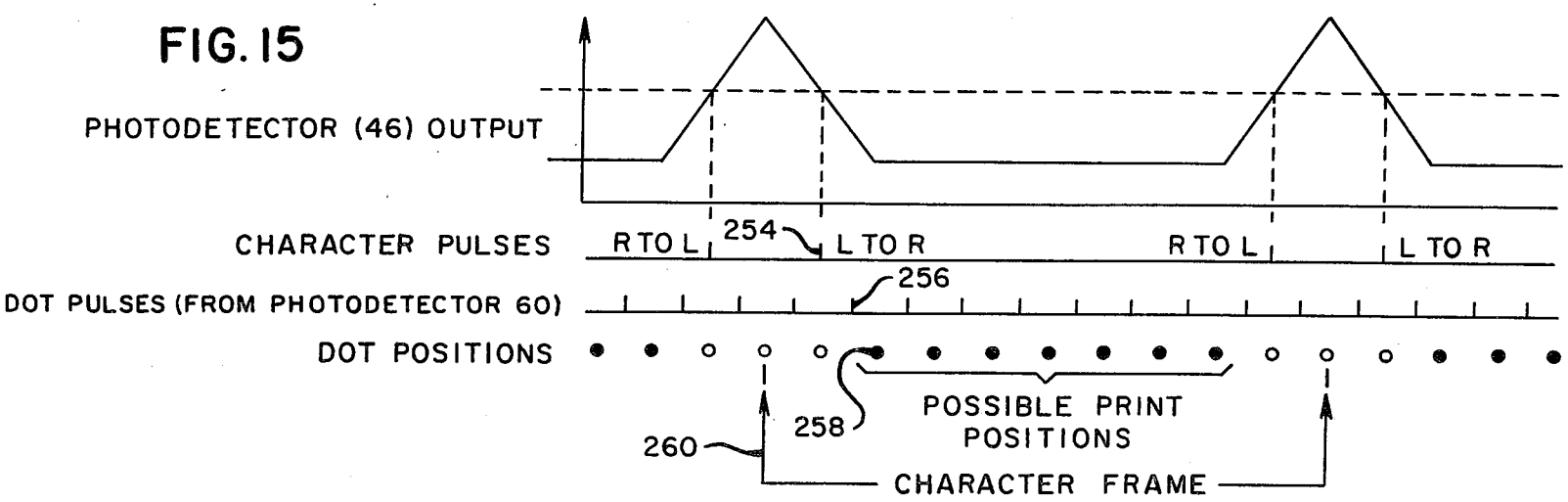
FIG. 15 is a diagram similar to FIG. 14 showing an embodiment which has a greater number of possible print positions within a recording frame than the embodiment shown in FIG. 14.

The embodiment shown in FIG. 15 is generally similar to that shown in FIG. 14 in that the character pulse shown at 254 occurs at a falling light level (when printing from left to right) and the next dot pulse shown at 256 is utilized for printing at the first print position 258 within the character frame 260; however, there are seven possible print positions instead of five within the character frame 260. Notice, also, that in the embodiments shown in FIGS. 12 and 13, the first dot pulse (like 226 in FIG. 12) after the character pulse (like 220 in FIG. 12) is utilized to define the start of a character frame 223 whereas the first dot pulse (like 246 in FIG. 14) after a character pulse (like 244 in FIG. 14) defines the first possible print position. The embodiments shown in FIGS. 12 and 13 may be used for printing or "painting" large characters for supermarket shelf labels, for example, which may not require intercharacter gaps whereas the embodiments shown in FIGS. 14 and 15 embody simplicity in that the first dot pulse after a character pulse may be used for printing at the first possible print position.

Figure 9:
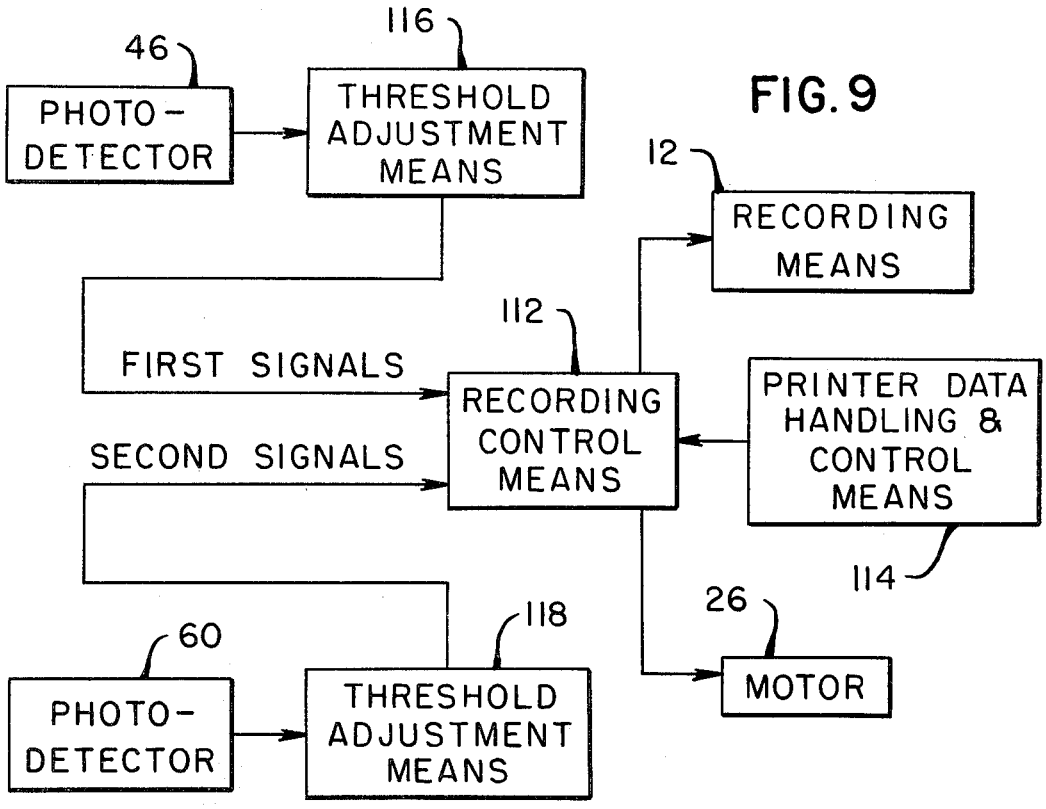
FIG. 9 is a schematic diagram, in block form, showing a control means for controlling the apparatus of this invention.

The printer data handling and control means 114 shown in FIG. 9 may be conventional and employs a counter means (not shown) for counting the character pulses such as 220 in FIG. 12 to locate the start of printing along the line of printing 14 and it also includes the usual buffering means to store an entire line of printing prior to printing. The control means 114 also includes a processor to decide whether the entire line of printing is to be printed when proceeding from left to right or from right to left depending upon which strategy is most efficient, given the starting position of the recording means 12. The interaction between the recording control means 112 and the recording means 12 is also conventional. As these techniques are well-known and not a part of this invention, they need not be described in further detail.

What is claimed is:

1. An apparatus for producing imprints along a line on a recording medium comprising:

a recording means movable along said line relative to said medium and operable in response to first and second signals applied thereto for producing selected said imprints along said line;

first means for generating said first signals whereby successive said first signals define recording frames for said recording means along said line;

second means for generating said second signals which are utilized by said recording means for producing said selected imprints within said recording frames;

said first and second means each comprising:

a first synchronization track having spaced synchronization marks thereon and being fixed relative to said recording medium;

a second synchronization track having spaced synchronization marks thereon and also being movable with said recording means; and a light source and detector means being positioned in light coupling relationship with said first and second synchronization tracks to generate the associated said first and second signals as said recording means moves along said line.

2. The apparatus as claimed in claim 1 in which said first and second synchronization tracks each have light-impervious areas located between adjacent associated said synchronization marks which are light-pervious areas, and in which each of said first and second synchronization tracks has a repeating pattern of said light-impervious areas and light-pervious areas whereby each said first signal has a duration in time which is small when compared to the duration in time between successive said first signals as said recording means is moved along said line.

3. The apparatus as claimed in claim 2 in which said first and second tracks of said first means are identical.

4. The apparatus as claimed in claim 2 in which said second means has a repeating pattern of said light-impervious areas and light-pervious areas whereby a plurality of said second signals is generated within said recording frames as said recording means moves along said line.

5. The apparatus as claimed in claim 4 in which said repeating patterns of said first and second tracks of said first means are identical and also are comprised of a light-impervious area having a first width and a light-pervious area having a width equal to twice said first width.

6. The apparatus as claimed in claim 4 in which said repeating patterns of said first and second synchronization tracks of said first means are identical and are also comprised of a first light-impervious area having a first width, a first light-pervious area having a width equal to said first width, a second light-impervious area having a width equal to three times said first width, and a second light-pervious area equal to two times said first width.

7. The apparatus as claimed in claim 4 in which said repeating patterns of said first and second synchronization tracks of said first means are identical and also are comprised of a first light-impervious area having a first width, a first light-pervious area having a width equal to said first width, a second light-impervious area having a width equal to five times said first width, a second light-pervious area having a width equal to said first width, a third light-impervious area having a width equal to three times said first width, and a third light-pervious area having a width equal to two times said first width.

8. The apparatus as claimed in claim 4 in which said repeating pattern of said first synchronization track of said second means is comprised of a light-impervious area having a first width and a light-pervious area having a width which is twice said first width, and in which said repeating pattern of said second synchronization track of said second means is comprised of a light-impervious area having a width which is twice said first width and a light-pervious area having a width which is equal to said first width.

9. The apparatus as claimed in claim 4 in which said detector means of said first means generates an output whose intensity varies as said recording means is moved along said line and in which said apparatus further comprises means for adjusting the level of said intensity of said output at which said first signals are generated.

10. The apparatus as claimed in claim 9 in which ech said output of said detector means of said first means is comprised of a rising slope representing increasing intensity and a falling slope representing decreasing intensity, whereby, each associated said first signal is generated from said rising slope, and whereby a said second signal is generated in time between the generation of a said first signal and the commencement of the falling slope as said recording means is moved along said line.

11. The apparatus as claimed in claim 4 in which each said output of said detector means of said first means is comprised of a rising slope representing increasing intensity and a falling slope representing decreasing intensity, whereby each said first signal is generated from an associated falling slope, and whereby a said second signal is generated in time between the generation of a said first signal and the commencement of the falling slope as said recording means is moved along said line.

12. The apparatus as claimed in claim 4 in which said detector means of said second means generates an output whose intensity varies as said recording means is moved along said line and in which said apparatus further comprises means for adjusting the level of said intensity of said output of said detector means of said second means at which said second signals are generated to provide for accurate alignment of said imprints when said recording means is moved in opposed directions along said line.

13. The apparatus as claimed in claim 1 in which said first and second tracks of said first and second means are planar in shape and are positioned parallel to said line.

14. The apparatus as claimed in claim 1 in which each said detector means of said first and second means produces an output whose intensity varies as said recording means is moved along said line, and in which each of first and second means includes means for adjusting the level of intensity of the associated said output at which said associated first and second signals are generated.

15. A printer for producing imprints bi-directionally along a line on a recording medium comprising:

a recording means;

means for moving said recording means along said line relative to said medium, said recording means being operable in response to first and second signals applied thereto for producing selected said imprints along said line;

first means for generating said first signals whereby successive said first signals define recording frames for said recording means along said line;

second means for generating said second signals which are utilized by said recording means for producing said selected imprints within said recording frames;

said first and second means each comprising:

a first synchronization track having spaced synchronization marks thereon and being fixed relative to said recording medium;

a second synchronization track having spaced synchronization marks thereon and also being movable with said recording means; and a light source and detector means being positioned in light coupling relationship with said first and second synchronization tracks to generate the associated said first and second signals as said recording means moves along said line;

said first and second synchronization tracks of said first and second means being planar in shape and being positioned parallel to said line.

16. The printer as claimed in claim 15 in which each said detector means of said first and second means produces an output whose intensity varies as said recording means is moved along said line, and in which each of first and second means includes means for adjusting the level of intensity of the associated said output at which said associated first and second signals are generated.

* * * * *